US010160582B2

(12) United States Patent
Gagne et al.

(10) Patent No.: US 10,160,582 B2
(45) Date of Patent: Dec. 25, 2018

(54) PACKAGE INTEGRITY FEATURE FOR RECLOSEABLE PACKAGE

(71) Applicant: Sonoco Development, Inc., Hartsville, SC (US)

(72) Inventors: Joseph Donald Gagne, Holyoke, MA (US); Eugene Tirrell Smith, Charlotte, NC (US)

(73) Assignee: Sonoco Development, Inc., Hartsville, SC (US)

( * ) Notice: Subject to any disclaimer, the term of this patent is extended or adjusted under 35 U.S.C. 154(b) by 385 days.

(21) Appl. No.: 15/017,743

(22) Filed: Feb. 8, 2016

(65) Prior Publication Data

US 2016/0236844 A1 Aug. 18, 2016

Related U.S. Application Data

(60) Provisional application No. 62/115,683, filed on Feb. 13, 2015.

(51) Int. Cl.

| | |
|---|---|
| ***B65D 33/20*** | (2006.01) |
| ***B65D 75/58*** | (2006.01) |
| ***B65D 75/26*** | (2006.01) |

(52) U.S. Cl.

CPC ..... *B65D 75/5838* (2013.01); *B65D 75/26* (2013.01); *B65D 2101/0015* (2013.01); *B65D 2575/586* (2013.01)

(58) Field of Classification Search

CPC ..... B65D 75/5838; B65D 75/585

See application file for complete search history.

(56) References Cited

U.S. PATENT DOCUMENTS

| | | | |
|---|---|---|---|
| 7,717,620 | B2 | 5/2010 | Hebert et al. |
| 8,408,792 | B2 | 4/2013 | Cole et al. |
| 2013/0064934 | A1 | 3/2013 | Vogt et al. |
| 2013/0270268 | A1 | 10/2013 | Lyzenga et al. |
| 2014/0079343 | A1* | 3/2014 | Lyzenga ..... B65B 61/182 383/203 |

* cited by examiner

*Primary Examiner* — William P Watkins, III

(74) *Attorney, Agent, or Firm* — Miller, Matthias & Hull LLP

(57) ABSTRACT

A package integrity feature for a recloseable package is provided. The recloseable package may be made from a laminate film and may comprise a scored inner layer having a machine direction and a scored outer layer laminated together with both permanent adhesive and pressure sensitive adhesive to form a recloseable flap that covers an opening in a package body. The package integrity feature may be a strip of material cut into the inner layer of the laminate film in such a way that the strip breaks when the package is opened, leaving one end of the strip attached to the package body and the opposite end attached to the recloseable flap.

14 Claims, 4 Drawing Sheets

PACKAGE INTEGRITY FEATURE FOR RECLOSEABLE PACKAGE

BACKGROUND

1. Field of the Invention

This patent relates to a package integrity feature for a recloseable package.

2. Description of the Related Art

Recloseable flexible packages have been very popular with consumers. At their most basic, recloseable packages comprise a scored inner layer and a scored outer layer laminated together with both permanent adhesive and pressure sensitive adhesive. Prior to being joined to the inner layer, the outer layer can be treated on its inner facing surface to render it more receptive to ink and/or more readily bondable to the pressure-sensitive adhesive. The package may be filled with cookies, crackers or other suitable content and closed at both ends by heat sealing or cold sealing.

A recloseable flap allows the package to be repeatedly opened and resealed. By pulling a pull tab the user can lift the recloseable flap away from the package body and then press the recloseable flap to the body to adhere the flap to the pressure sensitive adhesive, thus resealing the package.

Recently, package integrity features (PIFs) have been added to recloseable packages to indicate that a package has been opened. One type of PIF is a strip that is cut into the inner layer of the laminated film so that one end of the strip always remains attached to the package body while the opposite end remains attached to the recloseable flap. When the recloseable flap is lifted, the strip may stretch until a weakened middle section breaks, leaving one portion of each strip attached to the package body while the other portion remains attached to the recloseable flap.

Unfortunately, sometimes the strip will stretch and break below the weakened portion, leaving an elongated strand of film hanging from the package body into the package interior. Accordingly, an improved package integrity feature has been developed that addresses this problem.

SUMMARY OF THE INVENTION

The present invention is a package integrity feature for a recloseable package. The recloseable package may be made from a laminate film and may comprise a scored inner layer having a machine direction and a scored outer layer laminated together with both permanent adhesive and pressure sensitive adhesive to form a recloseable flap that covers an opening in a package body.

In one aspect the package integrity feature may be a strip of material cut into the inner layer of the laminate in such a way that when the package is opened by lifting the recloseable flap, one end of the strip remains attached to the package body while the opposite end remains attached to the recloseable flap. More specifically, the strip may comprise an elongated top portion that remains attached to the package body, a relatively narrow (and thus weaker) neck portion that breaks when the recloseable flap is lifted and the package is first opened, and a base portion that remains attached to the recloseable flap.

The top portion extends from the package body to the relatively narrower neck portion and is defined by a set of first cuts formed in the inner layer substantially parallel to the machine direction.

The base portion extends from the relatively narrower neck portion away from the top portion and terminates in a bottom end. The base portion is defined by a set of second cuts formed in the inner layer. The second cuts form substantially a V-shape with the broader part of the "V" located at the bottom end of the strip. Instead of running substantially parallel to the machine direction like the first cuts, each second cut and the machine direction are oblique (neither parallel nor perpendicular to each other). This configuration allows the base portion greater strength and resistance to failure when the recloseable flap is lifted from the package body, assuring that the strip will break at the neck portion rather than farther down the strip.

THE DRAWINGS

DETAILED DESCRIPTION OF THE INVENTION

Figure 1:
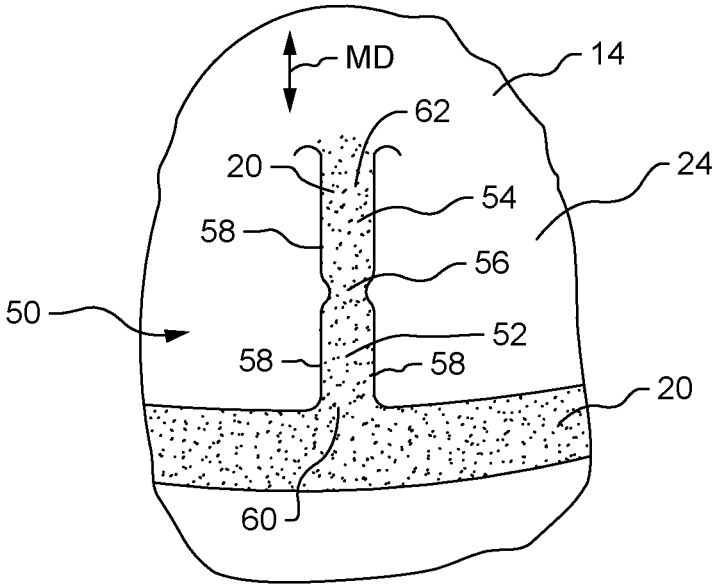
FIG. 1 PRIOR ART
FIG. 1 is a top plan view of a prior art package integrity feature.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments. For example, while the package integrity feature described below is used in a flexible package in which film layers are laminated together with both permanent adhesive and pressure sensitive adhesive, it should be understood that the package integrity feature may be used in other suitable types of packages.

Recloseable flexible packages comprise a laminated film having a scored inner layer and a scored outer layer laminated together with both permanent adhesive and pressure sensitive adhesive. The package can be repeatedly opened and resealed. By pulling a pull tab the user can lift a recloseable flap away from the package body and then press the recloseable flap to the body to adhere the flap to the pressures sensitive adhesive, thus resealing the package.

Recently, package integrity features (PIFs) have been added to such packages to indicate that the package has been opened. One type of PIF is a strip that is cut into the inner layer of the laminated film and has one end attached to the recloseable flap and the other end attached to the package body. When the package is opened the strip breaks, providing a visual indication that the package has been opened. The breaking of the strip may be preceded by a stretching of the strip, followed by the breaking of the strip, which may be accompanied by an audible snapping sound.

FIG. 1 is a top plan view of a prior art package integrity feature. The package integrity feature is a strip 50 generally formed by making parallel cuts 58 in the inner layer 14 of a package in the machine direction (MD). The strip 50 comprises a narrow (weaker) neck (middle) portion 56 that divides the strip 50 into a first (top) portion 52 and a second (base) portion 54. The top portion 52 terminates in an uncut top end 60 opposite the base 54, and the base portion 54 terminates in an uncut bottom end 62 opposite the top portion 52.

The strip 50 is adhered to an upper layer (not shown) with pressure sensitive adhesive (PSA) 20. The upper layer has a recloseable flap. When the recloseable flap is lifted, generally the strip 50 stretches until the weakened middle section 56 breaks, leaving the top portion 52 of each strip 50 attached to the package body while the base portion 54 remains attached to the recloseable flap. The break may or may not be accompanied by an audible snapping sound.

Unfortunately, sometimes the strip 50 will stretch and break along the base portion 54 below the neck portion 56, leaving an elongated strand of film hanging from the package body into the package interior. It is believed this can occur because the strength of the elongated strip 50 below the weakened neck section 56 has a lower tensile strength than the strip 50 in the weakened neck section area 56, causing the failure to occur where it is not desirable. Accordingly, an improved package integrity feature has been developed that addresses this problem.

Figure 2:
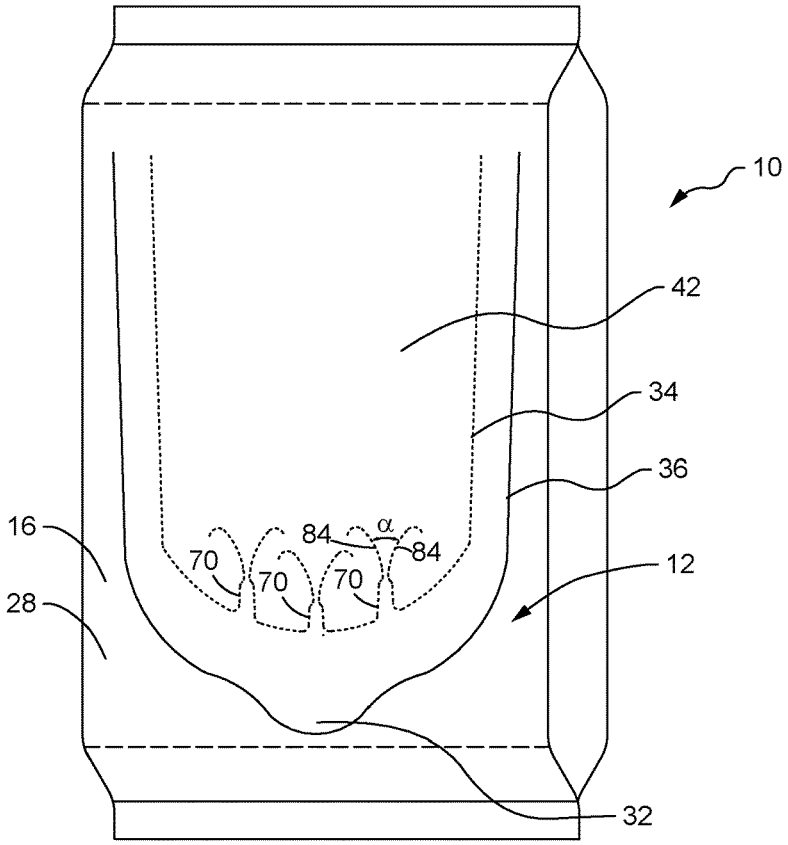
FIG. 2 is perspective view of a recloseable flexible package having package integrity features according to the disclosure.

FIG. 2 is perspective view of a recloseable flexible package having package integrity features according to the disclosure, shown in the closed condition. Except for the PIFs, the flexible package 10 may be made according to the method(s) disclosed in U.S. Pat. Nos. 7,717,620; 8,262,830 and 8,262,832, each of which is incorporated herein by reference.

At its most basic, the package 10 is made from a laminate film 12 and comprises a scored inner layer 14 and a scored outer layer 16 laminated together with both permanent adhesive 18 and pressure sensitive adhesive 20.

The outer layer 16 may be made of polyester film or any suitable material and typically is about 20 microns thick. The outer layer 16 has an inner facing surface 26 and an outer facing surface 28. The outer layer 16 may be transparent and may bear reverse printing on its inner facing surface 26. Prior to being joined to the inner layer 14, the inner facing surface 26 of the outer layer 16 can be treated by a corona discharge or similar apparatus to render the inner facing surface 26 more receptive to ink and/or more readily bondable to adhesives.

An optional metallization layer or foil layer (not shown in the figures) may be interposed between the inner layer 14 and the outer layer 16. The metallization layer or foil layer can be helpful in preventing a laser or die cutting machine from penetrating through the entire thickness of the laminate film 10 as described more fully below.

Figure 5:
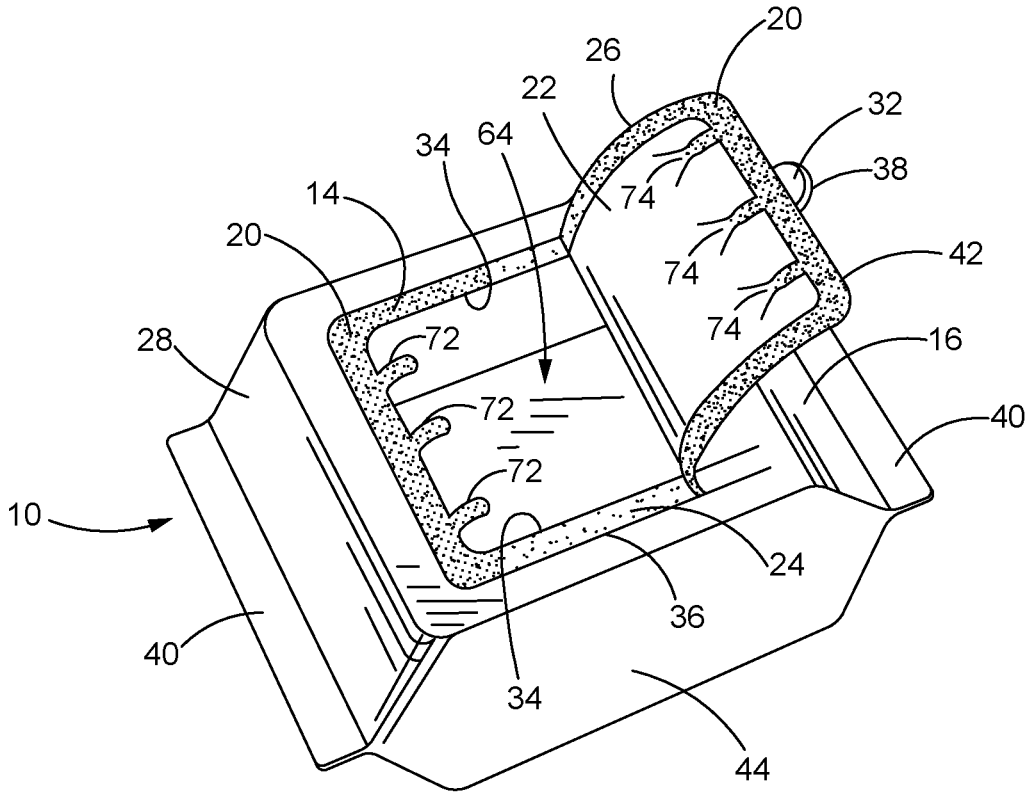
FIG. 5 is a perspective view of the flexible package of FIG. 2 after being opened.

The package 10 may be filled with cookies, crackers or other suitable content and closed at both ends 40 as shown in FIG. 5, for example, by heat sealing or cold sealing. The package 10 includes a recloseable flap 42 and an adhesive free pull tab 32 which allows the package 10 to be repeatedly opened and resealed. The package 10 also includes a series of package integrity features 70 as will now be described with particular reference to FIG. 3.

Figure 3:
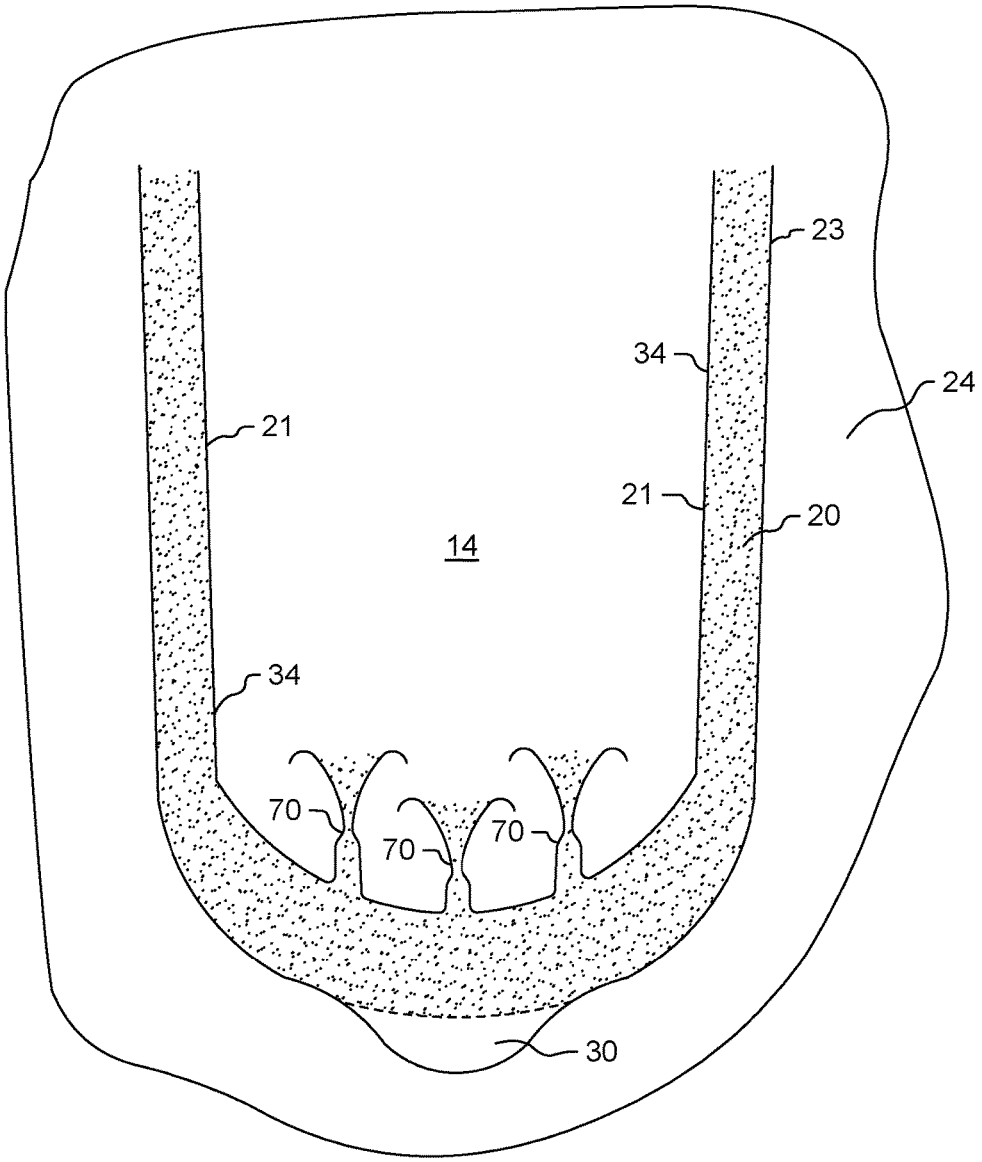
FIG. 3 is a top plan view of an inner layer of material and the package integrity features of the present disclosure.

FIG. 3 is a top plan view of a portion of the inner layer 14. The inner layer 14 may be made of polyolefin film or any suitable material and typically is about 20 to 70 microns thick. The inner layer 14 may also comprise multiple layers of various materials, including for example, a barrier layer providing a barrier against the passage of oxygen and/or moisture, and a sealant layer. The inner layer 14 has an inner facing (product facing) surface 22 and an outer facing surface 24.

Pressure sensitive adhesive (PSA) 20 may be pattern applied to the outer facing surface 24 of the inner layer 14 in a predetermined area of the inner layer 14. The pattern may be any suitable pattern but may be in a U-shape pattern 20 like that shown in FIG. 3.

A permanent adhesive may be pattern applied onto the outer facing surface 24 of the inner layer 14 such that the permanent adhesive does not cover the PSA 20. Preferably the permanent adhesive also does not cover a small area 30 of the inner layer 14 which will be overlaid with a pull tab 32 so that the pull tab 32 is not adhered to the inner layer 14. However, the permanent adhesive should cover a sufficient portion of the inner layer 14 to permit it to be laminated to the outer layer 16.

Alternatively, the PSA may be pattern applied to the inner facing surface 26 of the outer layer 16 in a predetermined area of the outer layer 16, and the permanent adhesive may be pattern applied onto the inner facing surface 26 of the outer layer 16 such that the permanent adhesive does not cover the PSA 20.

The inner layer 14 may further comprise an undercut 34. The undercut 34 may extend through the entire thickness or almost the entire thickness of the inner layer 14. The undercut 34 should be in registration with the inside border 21 of the PSA pattern 20, and may be substantially U-shaped as shown in the figures.

Package integrity features 70 may be cut into the inner layer 14. Each package integrity feature 70 may take the form of a somewhat elastic strip 70 comprising a first (top) portion 72 and a second (base) portion 74 separated by a weakened neck portion (middle) portion 76.

Figure 4:
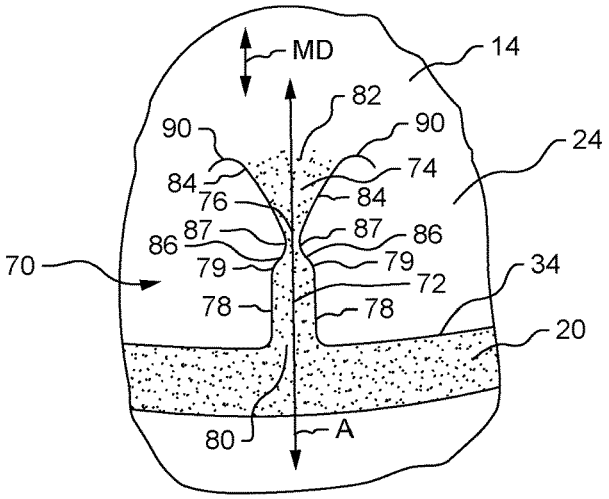
FIG. 4 is a close up view of one of the package integrity features of FIG. 2.

FIG. 4 is a close up view of one of the package integrity features of FIG. 3. The top portion 72 may be defined by a set of substantially parallel first cuts 78 formed in the inner layer 14. The first cuts 78 may run in the machine direction and extend from the undercut 34 in a direction away from the "race track"—the pattern formed by the pressure sensitive adhesive (PSA) 20—and terminate near the neck portion 76. The top portion 72 may be elongated and may extend from an uncut top end 80 adjacent the race track to a relatively narrower neck portion 76.

The neck portion 76 may be defined by two sets of cuts 84, 86 formed in the inner layer 14. The first set of cuts 86 may be contiguous with the parallel cuts 78. That is, the first set of cuts 86 may extend from distal ends 79 of the parallel cuts 76 away from the top end 80. The first cuts 86 converge toward each other in the direction away from top end 80 until each converging cut 86 terminates at a proximal end 87. The proximal ends 87 represent the narrowest part of the strip 70. Thus the neck portion 76 is relatively narrower and weaker than either the top portion 72 or the base portion 74.

The base portion 74 extends from the neck portion 76 in a direction away from the top portion 78 to a bottom end 82 and may be defined by a set of second cuts 84 formed in the inner layer 14.

In a key aspect of the invention, the second cuts 84 that form the base portion 74 diverge away from each other in the direction away from the top portion 72, forming substantially a V-shape with the broader part of the "V" located at the bottom end 82 of the strip 70. Instead of running substantially parallel to the machine direction (MD) like the first cuts 78, each second cut 84 and the machine direction (MD) are oblique, that is, neither parallel nor perpendicular to each other. This allows the base portion 74 greater strength and resistance to failure when the recloseable flap 42 is lifted from the package body 44.

The second cuts 84 may terminate in end portions 90 that curve back, preferably outwardly (away from each other) toward the top portion 72 of the strip 70.

It is expected that the second cuts 84 may form an included angle (a) of at least 45 degrees and preferably closer to or equal to 90 degrees for maximum effectiveness. The second cuts 84 may or may not be symmetrical about an axis (A) defined by the strip 70 and parallel to the machine direction.

The strip 70 is adhered to the upper layer 16 with pressure sensitive adhesive 20. When the recloseable flap 42 is lifted, the strip 70 may stretch until the weakened middle section neck portion 76 breaks, leaving the top portion 72 of each strip 70 attached to the package body 44 while the base portion 74 remains attached to the recloseable flap 42 as shown in FIG. 5.

In another aspect of the invention, a package integrity feature 70 is provided for use with a package made from a laminate film. The package integrity feature 70 comprises an elongated top portion 72, a neck portion 76 and a base portion 74. The elongated top portion 72 extends from a top end 80 to the relatively narrower neck portion 76 and is defined by a set of substantially parallel first cuts 78 formed in the laminate film. The base portion 74 extends from the relatively narrower neck portion 76 away from the top portion 72 to a bottom end 82 and is defined by a set of second cuts 84 formed in the laminate film. The second cuts 84 diverge away from each other in a direction away from the top portion 72.

Data

To demonstrate that divergent second cuts 84 reduce the failure rate of product integrity features 70, product integrity features 70 with varying shapes were tested. The sampling was conducted on flat stock that was about one week old. The structure was 92 ga PET/ink/adv/PSA/98 ga wOPP. 100 samples per variable were tested. Failures unrelated to the Divergency (Angle (α)) were not included in the data. The product integrity features were laser scored. The data is summarized in the following table:

TABLE A

| Degree of Divergency (Angle (α)) | Failure Rate |
|---|---|
| 90 | 3% |
| 60 | 2% |
| 30 | 10% |

While all samples performed well, samples with product integrity features having an angle of divergence of 60 degrees and 90 degrees performed even better than samples with product integrity features having an angle of divergence of 30 degrees. Thus product integrity features 70 having the second cuts 84 forming an included angle (α) of at least 30 degrees appear to be operable, while product integrity features 70 having the second cuts 84 forming an included angle (α) of at least 60 degrees appear to be preferred. It is believed that product integrity features 70 having the second cuts 84 forming an included angle (α) of greater than zero degrees will provide benefits as well.

Method of Manufacture

To make the recloseable flap 42, permanent and pressure sensitive adhesives are applied between the inner and outer layers 12, 14 in predetermined patterns, then the inner and outer layers 14, 16 are laminated together. Once the laminated film 12 is formed, precise scoring operations are performed on either side of the laminated film 12 in registration with the adhesive patterns, with each scoring operation only penetrating through one layer of the laminated film 12.

More specifically, the flexible package 10 with recloseable feature may be made in the following manner:

First, an inner layer 14 of flexible film material and an outer layer 16 of flexible film material are provided in sheet form.

Pressure sensitive adhesive (PSA) 20 is pattern applied to the outer facing surface 24 of the inner layer 14 in a predetermined area 20 of the inner layer 14. The pattern may be any suitable pattern but may be in a U-shape or "race track" pattern 20 like that shown in FIGS. 1 and 3. The PSA 20 may be dried at a drying station such as an oven or the like.

A permanent adhesive 18 may be pattern applied onto the outer facing surface 24 of the inner layer 14 such that the permanent adhesive 18 does not cover the PSA 20. Preferably the permanent adhesive 18 also does not cover a small area 30 of the inner layer 14 which will be overlaid with a pull tab 32 so that the pull tab 32 is not adhered to the inner layer 14. However, the permanent adhesive 18 should cover a sufficient portion of the inner layer 14 to permit it to be laminated to the outer layer 16.

Next, the inner layer 14 and the outer layer 16 are adhesively joined via the PSA 20 and the permanent adhesive 18 to form the laminated film 12. This may be accomplished using a laminating machine comprising two rollers forming a nip therebetween. The inner layer 14 and the outer layer 16 should be substantially coextensive with each other during the laminating process. For example, if the layers 14, 16 are rectangular, the width and length of the inner layer 14 should match the width and length of the outer layer 16. The laminated 12 film may be rectangular or any shape suitable for forming the desired flexible package 10.

Next, a roll of the laminated film 12 is fed to a first scoring station where an undercut 34 may be scored in the inner layer 14. The undercut 34 may be formed with a laser, with a die cutting machine or by any suitable means and may extend through the entire thickness or almost the entire thickness of the inner layer 14. The undercut 34 should be in registration with the inside border 21 of the PSA pattern 20, and may be substantially U-shaped as shown in the figures. Package integrity features 70 may be cut into the inner layer 14 during this step as explained more fully below.

The roll of laminated film 12 may be fed to a second scoring station where an overcut 36 is formed in an outer facing surface 28 of the outer layer 16. The overcut 36 preferably is formed substantially in registration with the outside border 23 of the PSA 20, although it may overlap the PSA 20. The overcut 46 may be formed with a laser, with a die cutting machine or by any suitable means and may extend through the entire thickness or almost the entire thickness of the outer layer 16.

In the illustrated example, the undercut 34 forms a U-shaped pattern in registration with the inside border 21 of the PSA 20 and the overcut 36 forms a larger U-shaped pattern in substantial registration with the outside border 23 of the PSA 20 and substantially co-extensive with the undercut 44. An outwardly curved portion 38 of the overcut 36 defines a pull tab 32.

The laminated film 12 can now be rolled up for use in packaging products. For example and without limitation, the laminated film 12 can be used to wrap cookies or crackers at a cookie or cracker making facility. After the contents are placed inside the flexible package 10, one or both ends 40 may be sealed to create the filled package 10. The sealing may be accomplished by crimping, folding or otherwise closing off the ends 32 and then exposing the ends 32 to a temperature sufficient to at least partially melt the film 12 so that it fuses or welds together to form a heat seal if heat sealing is used. Alternatively, and without limitation, the ends 32 may be sealed using cold sealing.

Method of Use

FIG. 5 is a perspective view of the flexible package of FIG. 2 after being opened. The flexible package 10 can be opened by pulling the pull tab 32 formed in the outer layer 16 but not adhered to the inner layer 14. The recloseable flap 42 releases from the pressure sensitive adhesive 20, creating an opening 64 in the package body 44 through which the contents can be accessed.

More specifically, the upper layer 16 will break along the overcut 36 as the pull tab 32 is lifted, releasing the part of the upper layer 14 adhered to the PSA 20. At the same time, the part of the inner layer 14 underlying the flap 42 and permanently adhered to the upper layer 16 will stay adhered to the upper layer 16 and thus the recloseable flap 42. Together these parts of the inner and outer layers 14, 16 form the recloseable flap 42 shown in FIG. 3. The parts of the inner layer 14 and upper layer 16 that do not form the recloseable flap 42 form the package body 44. The undercut 34 and the part of the recloseable flap 42 that remains attached to the package body 44 define the opening 64 which allows access to the package contents.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A package integrity feature for a recloseable package made from a laminate film and comprising a scored inner layer and a scored outer layer laminated together with both permanent adhesive and pressure sensitive adhesive, the package integrity feature comprising:

an elongated top portion extending from a top end to a relatively narrower neck portion and defined by a set of substantially parallel first cuts formed in the inner layer; and a base portion extending from the relatively narrower neck portion away from the top portion to a bottom end and defined by a set of second cuts formed in the inner layer, the second cuts diverging away from each other in a direction away from the top portion wherein:

the inner layer has a machine direction;

the first cuts run substantially parallel to the machine direction; and each second cut is oblique to the machine direction.

2. The package integrity feature of claim 1 wherein the second cuts form substantially a V-shape.

3. The package integrity feature of claim 1 wherein the second cuts form an included angle of at least 45 degrees.

4. The package integrity feature of claim 1 wherein the second cuts form an included angle of about 90 degrees.

5. A package integrity feature for a recloseable package, the recloseable package made from a laminate film and comprising a scored inner layer having a machine direction and a scored outer layer laminated together with both permanent adhesive and pressure sensitive adhesive to form a recloseable flap and a package body, the package integrity feature comprising:

an elongated top portion extending from the package body to a relatively narrower neck portion and defined by a set of first cuts formed in the inner layer substantially parallel to the machine direction; and a base portion extending from the relatively narrower neck portion away from the top portion to a bottom end and defined by a set of second cuts formed in the inner layer, each second cut and the machine direction being oblique.

6. A package integrity feature for a package made from a laminate film, the package integrity feature comprising:

an elongated top portion extending from a top end to a relatively narrower neck portion and defined by a set of substantially parallel first cuts formed in the laminate film; and a base portion extending from the relatively narrower neck portion away from the top portion to a bottom end and defined by a set of second cuts formed in the laminate film, the second cuts diverging away from each other in a direction away from the top portion.

7. The package integrity feature of claim 6 wherein the second cuts form substantially a V-shape.

8. The package integrity feature of claim 6 wherein the second cuts form an included angle of greater than 0 degrees.

9. The package integrity feature of claim 6 wherein the second cuts form an included angle of at least 30 degrees.

10. The package integrity feature of claim 6 wherein the second cuts form an included angle of at least 60 degrees.

11. The package integrity feature of claim 6 wherein the second cuts form an included angle of about 90 degrees.

12. The package integrity feature of claim 1 wherein:

the second cuts terminate in end portions that curve away from each other.

13. The package integrity feature of claim 1 wherein:

the second cuts are asymmetrical about an axis defined by the machine direction.

14. The package integrity feature of claim 5 wherein:

when the recloseable flap is lifted, the package integrity feature stretches until the neck portion breaks, leaving the top portion attached to the package body while the base portion remains attached to the recloseable flap.

* * * * *